US010822898B2

(12) United States Patent
Doane

(10) Patent No.: US 10,822,898 B2
(45) Date of Patent: Nov. 3, 2020

(54) SETTABLE AND UNSETTABLE DEVICE AND METHOD

(71) Applicant: James Doane, Friendswood, TX (US)

(72) Inventor: James Doane, Friendswood, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 175 days.

(21) Appl. No.: 15/983,598

(22) Filed: May 18, 2018

(65) Prior Publication Data

US 2019/0352991 A1 Nov. 21, 2019

(51) Int. Cl.

| | |
|---|---|
| ***E21B 23/00*** | (2006.01) |
| ***E21B 23/04*** | (2006.01) |
| ***E21B 23/01*** | (2006.01) |
| ***E21B 33/128*** | (2006.01) |

(52) U.S. Cl.

CPC ..... *E21B 23/00* (2013.01); *E21B 23/01* (2013.01); *E21B 23/04* (2013.01); *E21B 33/128* (2013.01)

(58) Field of Classification Search

CPC ..... E21B 29/02; E21B 33/128; E21B 23/01; E21B 23/06; E21B 33/129; E21B 33/12955; E21B 23/04; E21B 23/02; E21B 23/03; E21B 23/0411; E21B 23/04115; E21B 31/20

See application file for complete search history.

(56) References Cited

U.S. PATENT DOCUMENTS

| | | | | |
|---|---|---|---|---|
| 5,273,116 | A * | 12/1993 | Ross | E21B 23/01 166/196 |
| 7,987,914 | B2 | 8/2011 | Benton | |
| 9,158,438 | B2 | 10/2015 | Roessler et al. | |
| 9,284,801 | B2 * | 3/2016 | Maguire | E21B 23/04 |
| 9,359,857 | B2 * | 6/2016 | O'Malley | E21B 33/124 |
| 2003/0019622 | A1 * | 1/2003 | Goodson, Jr. | F15B 21/065 166/66.5 |
| 2007/0284118 | A1 * | 12/2007 | Benton | E21B 34/06 166/386 |
| 2010/0163250 | A1 * | 7/2010 | Schultz | E21B 17/07 166/381 |
| 2011/0174484 | A1 * | 7/2011 | Wright | E21B 23/04 166/264 |
| 2012/0125640 | A1 * | 5/2012 | Sevre | E21B 33/128 166/387 |
| 2013/0256991 | A1 | 10/2013 | Ramon et al. | |
| 2015/0354304 | A1 * | 12/2015 | Wood | F03G 7/06 166/302 |

FOREIGN PATENT DOCUMENTS

| | | |
|---|---|---|
| WO | 2007031723 A2 | 3/2007 |

OTHER PUBLICATIONS

Notification of Transmittal of the International Search Report and the Written Opinion of the International Searching Authority, or the Declaration; PCT/US2019/026873; dated Aug. 1, 2019; 8 pages.

* cited by examiner

*Primary Examiner* — Michael R Wills, III

(74) *Attorney, Agent, or Firm* — Cantor Colburn LLP

(57) ABSTRACT

A settable device including a radially enlargeable portion, a force retention pathway operably connected to the radially enlargeable portion to maintain a setting force to the radially enlargeable portion, a material disposed within the force retention pathway of the device, the material retaining force when in solid form and disengaging force retention when in fluid form.

20 Claims, 3 Drawing Sheets

SETTABLE AND UNSETTABLE DEVICE AND METHOD

BACKGROUND

In the resource recovery industry devices are often set in tubular strings. The devices may be seals such as packers or may be anchors relying upon slips to bite into the material of the tubular. Many different types of device have been or continue to be used commercially and they work as intended. Sometimes, the devices need to be unset for various reasons. Commonly unsetting is done in three major ways, known vernacularly as cut, shear and shift. In the cut system, the packer is cut to be retrieved. The system requires that the ID and OD of the actual packer allow for conventional cutting and a cutting tool must be precisely located at the packer. Then a nickel alloy will need to be cut, which is inherently difficult to achieve as is well known. Shear release systems are simple but limit the tension that can be put on the packer without causing inadvertent shearing. The shifting system employs a collet support at the packer to be shifted in order to retrieve the packer. Drawbacks include inadvertent shifting during the running of other tools and the likelihood that any tubing string uphole of the packer will need to be pulled before removal of the packer. While the industry ubiquitously uses such configurations, it is always receptive to alternative configurations that provide an advantage in some way such as performance or cost reduction or improved ease of use.

SUMMARY

A settable device including a radially enlargeable portion, a force retention pathway (between 20 and 42 or between 20 and 160) operably connected to the radially enlargeable portion to maintain a setting force to the radially enlargeable portion, a material disposed within the force retention pathway (between 20 and 42 or between 20 and 160) of the device, the material retaining force when in solid form and disengaging force retention when in fluid form.

A method for unsetting a settable device as in any prior embodiment including, creating a temperature at the material greater than its melting point, transitioning the material to a fluid form, and allowing the material to flow thereby disengaging force retention.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
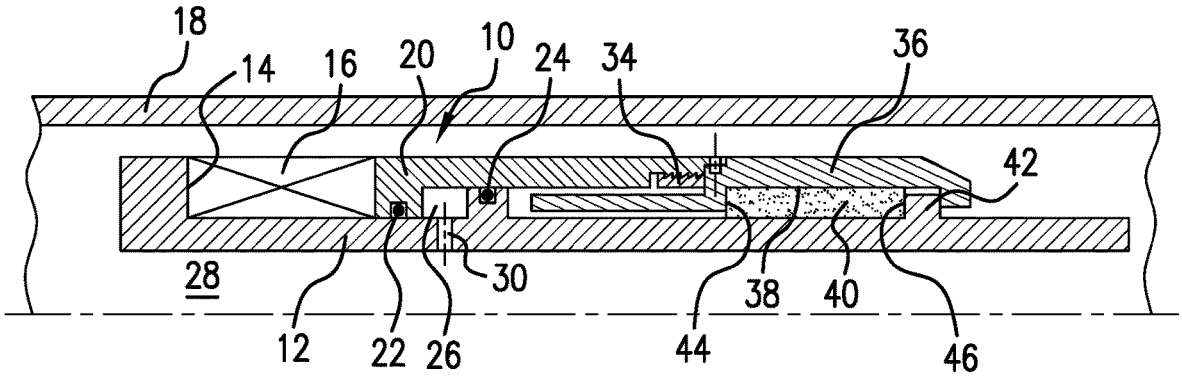
FIGS. 1*a*-1*c* are sequential views of a first embodiment of a settable device as described herein in a run-in position, a set position, and a retrieve position, respectively.
Figure 1B:
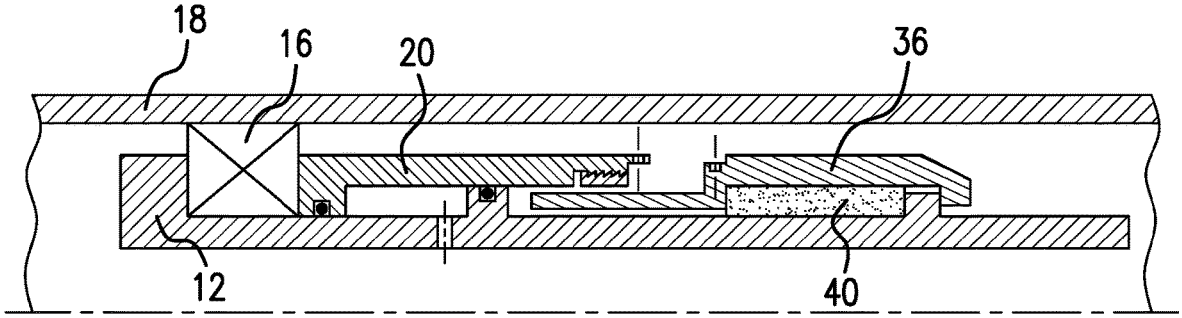
Figure 1C:
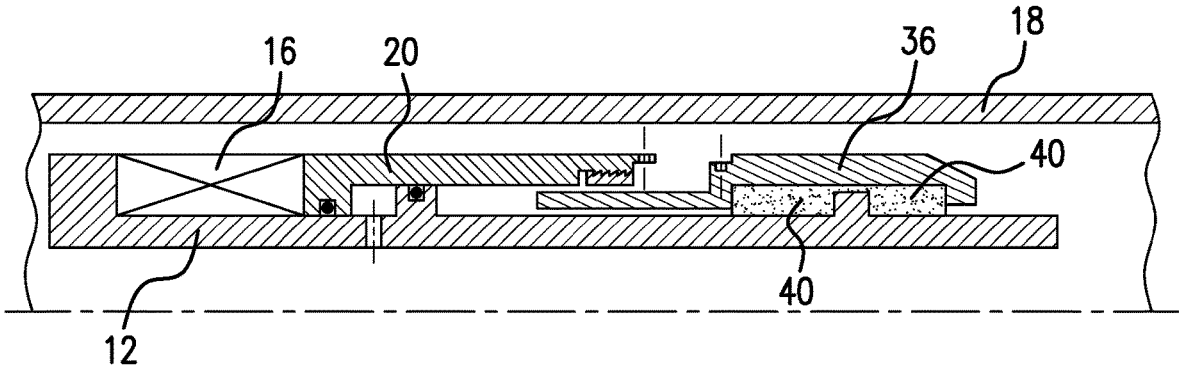
Figure 2A:
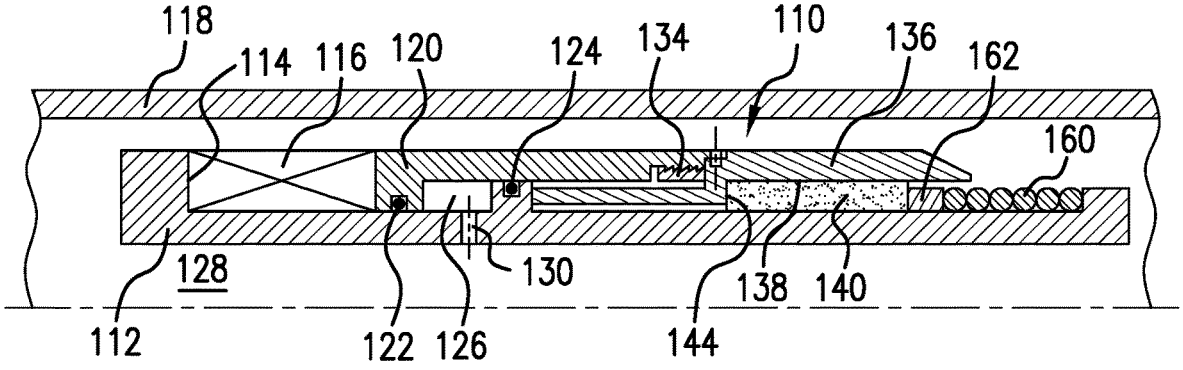
FIGS. 2*a*-2*d* are sequential views of a second embodiment of a settable device as described herein in a run-in position, a set position, and a retrieve position, respectively.
Figure 2B:
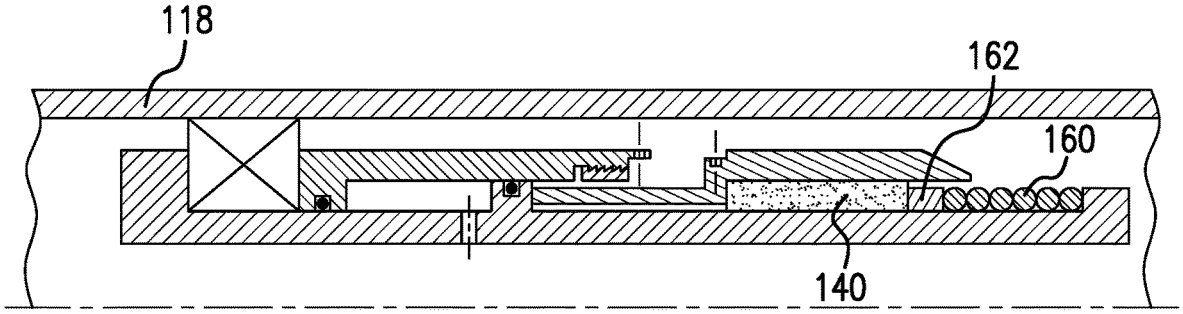
Figure 2C:
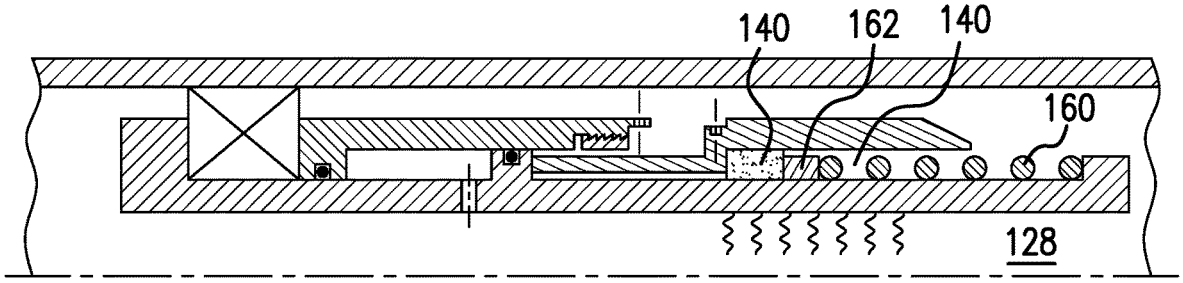
Figure 2D:
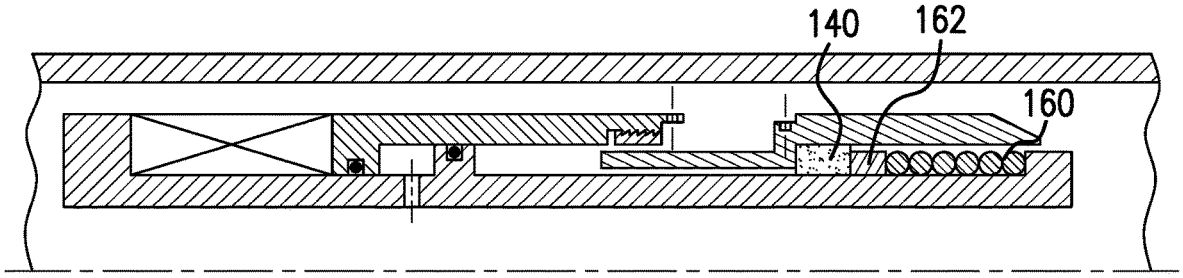

Referring to FIGS. 1*a*-1*c*, a settable device 10 may be configured as a seal such as a packer. The device 10 includes a mandrel 12. The mandrel has a shoulder 14 against which a seal element 16 is disposed. The element may be compressed against the shoulder 14 longitudinally in order to deform the element 16 radially into contact with a tubular 18 in which the device is to be set (set position illustrated in FIG. 1*b*). At an opposite side of the element 16 from the shoulder 14 is a piston 20. The piston 20 is slidingly sealed to the mandrel 12 at two places, 22 and 24 to produce a chamber 26. Chamber 26 is accessed fluidically from an inside diameter 28 of the mandrel 12 by port 30. Pressuring up on the ID 28 will cause pressure to build in the chamber 26 and cause piston 20 to move leftwardly in the figures thereby compressing the element 16 to set the same. Keeping the piston 20 in the set position is a body lock ring 34 interacting with the piston 20 and a support 36. The support 36 features a recess 38 that is filled with a material 40. Recess 38 also receives an upset 42 extending from the mandrel 12. It is to be appreciated that a surface 44 of recess 38 and a surface 46 of upset 42 are maintained at a set spacing from one another while the material 40 is in solid form and disposed therebetween. It should be understood that when the device 10 is pressured up upon, the chamber 26 will elongate causing the element 16 to radially enlarge while at the same time the body lock ring 34 will ratchet along the support 36. A force retention pathway is presented through piston 20, body lock ring 34, support 36, material 40, and upset 42 as the force needed to maintain the element 16 in the set position is retained through this pathway of components. The final position attained for the body lock ring 34 will be retained in the device 10 thereby ensuring the element 16 remains in the set position even though the pressure is relieved from the chamber 26. This set position illustrated in FIG. 1*b* will be retained indefinitely until it is desired to be undermined. Further, because of the solid material 40, the tensile rating of the device 10 is quite high. In other words, where tensile loads applied to a prior art packer would shear the release mechanism, the device 10 as disclosed herein does not release based upon the tensile load and hence is capable of managing a much higher tensile load thus increasing the utility of the device 10. Tensile loads in the range of 500,000 to 1,000,000 lbs are contemplated for device 10.

Moving to FIG. 1*c*, the undermining of the set position of device 10 has begun. This is occasioned by the material 40 being phase transitioned from a solid to a fluid, that fluid being a liquid or a gas or a mixture of the two. It is noted that some materials may be capable of sublimation and retain the function discussed herein. It is to be appreciated in FIG. 1*c* that the material is now visible on both longitudinal sides of the upset 42, the fluid having flowed between the upset 42 and the support 36 to escape the area between surface 44 and surface 46. This then means that surface 44 and surface 46 will be closer together than they were previously. Consequently the support is no longer holding the setting energy of the initial pressure up and the element will collapse into the unset position. Once unset, the device 10 may be moved to either another location or withdrawn to surface as desired.

The material may be a metal alloy such as a bismuth alloy, tin, solder or brazing alloys or other material including monomeric and polymeric materials that have a melting temperature that is conducive to a particular operation. For example, it may be desired to have the device 10 unset after simply having circulation stop for a period of time such that ambient wellbore temperature is recovered. Alternatively, it may be desirable to have the material require an input of thermal energy to melt and unset the device 10. Melting temperatures that may be desirable at 700-800 degrees F., for example. The thermal energy may be provided by electric resistance, chemical exothermic reaction, etc. within the mandrel whether run on wireline or spotted, etc. Alternatively it is also contemplated to mix an energetic material with the material 40 that can be ignited at a selected time thereby generating the thermal energy to melt the material 40 in situ. It should also be noted that the term melt as used herein is intended to mean that the material becomes sufficiently soft to change its position relative to the other components of the device 10 and achieve the results disclosed above. It may not be necessary for the phase transition to be complete in some embodiments. Once the material 40 is effectively removed from the force retention pathway, the device 10 may be retrieved through a retrieval pull. In the embodiment of FIGS. 1*a*-1*c*, the retrieval pull must occur while the material 40 is melting since if the material is melted and again allowed to solidify, the retrieval pull would be less or unsuccessful.

Referring to FIGS. 2*a*-2*d* an alternate embodiment having the same ultimate effect is illustrated. A device 110 differs from the foregoing in that there is no need to melt (note that the definition of the term "melting" is consistent here with that described above) the material 40 at the same time as a retrieval pull is occurring. Rather in the embodiment of FIG. 2, material 140 may be melted while the device 110 is still set and then the retrieval pull need only overcome a biasing member 160. The retrieval pull however may occur in the embodiment of FIG. 2*a*-2*c* after a conclusion of the melting of material 140. The setting will be identical with the device 110 using the material 140 as a part of the force retention pathway. Tensile loads in the range of 500,000 to 1,000,000 lbs are contemplated for device 110.

The components of FIGS. 2*a*-2*d* that are analogs of the embodiment of FIGS. 1*a*-1*c* bear 100 series equivalents of the component numerals in FIGS. 1*a*-1*c*. Hence they are merely listed seriatim for brevity, all having the same functions noted above. The device 110 comprises a mandrel 112; a shoulder 114; a seal element 116; a tubular 118; a piston 120 slidingly sealed to the mandrel 112 at two places, 122 and 124 to produce a chamber 126 the chamber accessed fluidically from an inside diameter 128 of the mandrel 112 by port 130; a body lock ring 134; a support 136; a recess 138 that is filled with the material 140. From here the device 110 deviates from the foregoing embodiment. The biasing member 160 bears against a slider 162, which may be a ring. At an opposite surface of the slider is disposed the material 140. In a way, the slider 162 is similar to upset 42 in that the material 140 is held between a surface 144 similar to surface 44 and the slider 162, similar to the upset 42. With the material 140 in solid form, these two structures cannot move toward each other and hence the device 110 remains set and locked. Once the temperature is permitted to reach the melting point of material 140, whether that is by recovering ambient wellbore temperature or through a thermal input of the types noted above, the biasing member 160 will move the slider 162 to the left in the Figures causing the material 140 to flow between the recess 138 and the slider 162. This allows the slider 162 to be brought closer to the surface 144 and consequently removes the lock on the set condition. Since this movement is caused by the biasing member 160, it is not necessary to pull on the device 110 during melting like in the previous embodiment but rather the melting can be undertaken first and then the retrieval pulling may occur later. The device 110 will remain set until the retrieval pull but will be unlocked and subject to retrieval pull once the material 140 is dispersed and hence the locking condition has been undermined. This may be useful in situations where a wireline or similar is used to deliver a heater to the device 110 to melt the material 140 since both delivering this heater on wireline while also inducing a retrieval pull may be difficult in some systems.

Figure 3:
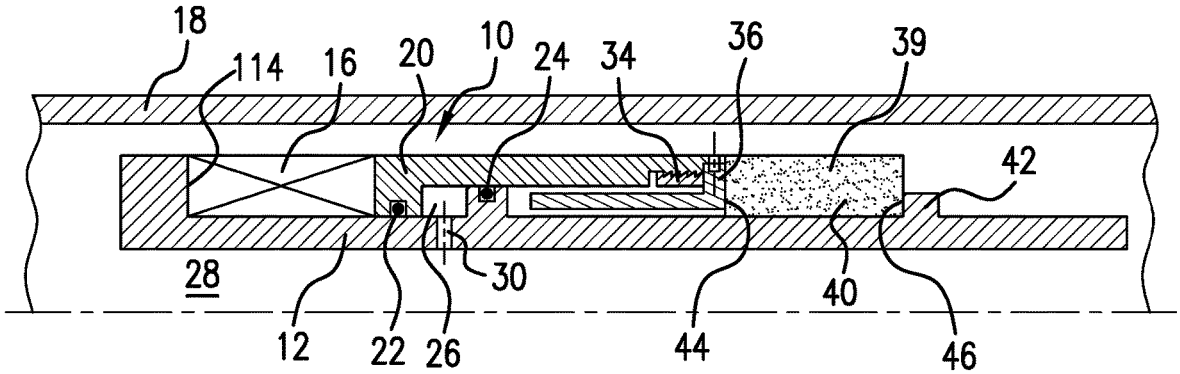
FIG. 3 is an alternate iteration of the FIG. 1 embodiment.
Figure 4:
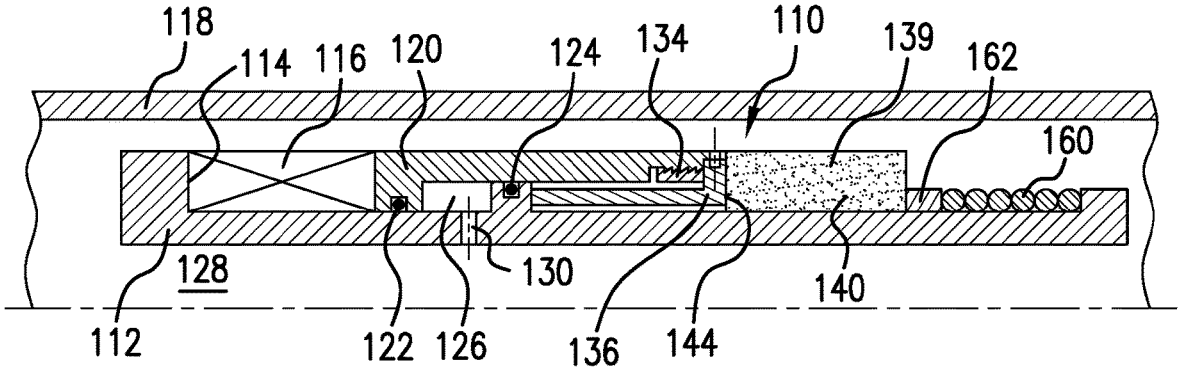
FIG. 4 is an alternate iteration of the FIG. 2 embodiment.

Referring to FIGS. 3 and 4, it is to be understood that the material 40 and 140 do not necessarily need to be disposed within a recess 38 or 138 but rather can actually make up any part or even the whole of any one of the components within the force retention pathway. In FIG. 3 this is represented with numeral 39 and in FIG. 4 with numeral 139. In each case, melting (same definition as above) of the portion or whole of whatever component of the force retention pathway will still result in an undermining of the force retention pathway and allow for retrieval.

Set forth below are some embodiments of the foregoing disclosure:

Embodiment 1

A settable device including a radially enlargeable portion, a force retention pathway (between 20 and 42 or between 20 and 160) operably connected to the radially enlargeable portion to maintain a setting force to the radially enlargeable portion, a material disposed within the force retention pathway (between 20 and 42 or between 20 and 160) of the device, the material retaining force when in solid form and disengaging force retention when in fluid form.

Embodiment 2

The device as in any prior embodiment wherein the radially enlargeable portion is a sealing element.

Embodiment 3

The device as in any prior embodiment wherein the radially enlargeable portion is an anchor.

Embodiment 4

The device as in any prior embodiment wherein the force retention pathway (between 20 and 42 or between 20 and 160) includes a member comprising the material.

Embodiment 5

The device as in any prior embodiment wherein the force retention pathway (between 20 and 42 or between 20 and 160) includes a member having a recess, the recess housing the material.

Embodiment 6

The device as in any prior embodiment wherein the force retention pathway (between 20 and 42) further includes an upset protruding into the recess.

Embodiment 7

The device as in any prior embodiment wherein the material maintains a position of the upset relative to the recess when in solid form and allows a change in relative position of the upset to the recess when in fluid form.

Embodiment 8

The device as in any prior embodiment wherein the force retention pathway (between 20 and 160) further includes a slider protruding into the recess.

Embodiment 9

The device as in any prior embodiment wherein the force retention pathway (between 20 and 160) further includes a biasing member.

Embodiment 10

The device as in any prior embodiment wherein the material has a melting temperature greater than ambient wellbore temperature.

Embodiment 11

The device as in any prior embodiment wherein the material has a melting temperature at or below ambient wellbore temperature.

Embodiment 12

The device as in any prior embodiment wherein the material includes a metal.

Embodiment 13

The device as in any prior embodiment wherein the metal is bismuth.

Embodiment 14

The device as in any prior embodiment wherein the fluid form includes a liquid.

Embodiment 15

The device as in any prior embodiment wherein the fluid form includes a gas.

Embodiment 16

A method for unsetting a settable device as in any prior embodiment including creating a temperature at the material greater than its melting point, transitioning the material to a fluid form, and allowing the material to flow thereby disengaging force retention.

Embodiment 17

The method as in any prior embodiment further comprising moving the settable device.

Embodiment 18

The method as in any prior embodiment wherein the creating is by resistance heating or chemical reaction.

Embodiment 19

The method as in any prior embodiment further comprising retrieving the device by pulling while creating.

Embodiment 20

The method as in any prior embodiment further comprising retrieving the device by pulling after creating.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A settable device comprising:

a radially enlargeable portion;

a force retention pathway operably connected to the radially enlargeable portion to maintain a setting force to the radially enlargeable portion;

a material disposed within the force retention pathway of the device, the material retaining force when in solid form and disengaging force retention when in fluid form.

2. The device as claimed in claim 1 wherein the radially enlargeable portion is a sealing element.

3. The device as claimed in claim 1 wherein the radially enlargeable portion is an anchor.

4. The device as claimed in claim 1 wherein the force retention pathway includes a member comprising the material.

5. The device as claimed in claim 1 wherein the force retention pathway includes a member having a recess, the recess housing the material.

6. The device as claimed in claim 5 wherein the force retention pathway further includes an upset protruding into the recess.

7. The device as claimed in claim 6 wherein the material maintains a position of the upset relative to the recess when in solid form and allows a change in relative position of the upset to the recess when in fluid form.

8. The device as claimed in claim 5 wherein the force retention pathway further includes a slider protruding into the recess.

9. The device as claimed in claim 5 wherein the force retention pathway further includes a biasing member.

10. The device as claimed in claim 1 wherein the material has a melting temperature greater than ambient wellbore temperature.

11. The device as claimed in claim 1 wherein the material has a melting temperature at or below ambient wellbore temperature.

12. The device as claimed in claim 1 wherein the material includes a metal.

13. The device as claimed in claim 1 wherein the metal is bismuth.

14. The device as claimed in claim 1 wherein the fluid form includes a liquid.

15. The device as claimed in claim 1 wherein the fluid form includes a gas.

16. A method for unsetting a settable device as claimed in claim 1 comprising:

creating a temperature at the material greater than its melting point;

transitioning the material to a fluid form; and allowing the material to flow thereby disengaging force retention.

17. The method as claimed in claim 16 further comprising moving the settable device.

18. The method as claimed in claim 16 wherein the creating is by resistance heating or chemical reaction.

19. The method as claimed in claim 16 further comprising retrieving the device by pulling while creating.

20. The method as claimed in claim 16 further comprising retrieving the device by pulling after creating.

* * * * *